United States Patent [19]

Rifkin

[11] 3,934,908

[45] Jan. 27, 1976

[54] LOCK WITH RETAINER

[75] Inventor: Michael Rifkin, Lyndhurst, N.J.

[73] Assignee: The Magne-Lok Co., Lyndhurst, N.J.

[22] Filed: Aug. 14, 1974

[21] Appl. No.: 497,417

[52] U.S. Cl. ..... 292/150; 70/77; 70/89

[51] Int. Cl.[2]. E05B 65/06; E05C 1/04; E05C 13/02

[58] Field of Search ..... 292/32, 33, 41, 42, 137, 292/138, 145, 146, 150; 70/89, 110

[56] References Cited

UNITED STATES PATENTS

| | | | |
|---|---|---|---|
| 211,838 | 2/1879 | Crawford | 292/150 X |
| 1,386,422 | 8/1921 | Ottinger | 292/150 X |
| 3,413,830 | 12/1968 | Rifkin | 292/150 X |

FOREIGN PATENTS OR APPLICATIONS

| | | | |
|---|---|---|---|
| 24,233 | 11/1901 | United Kingdom | 292/150 |

*Primary Examiner*—Paul R. Gilliam
*Assistant Examiner*—Carl F. Pietruszka
*Attorney, Agent, or Firm*—Blum Moscovitz Friedman & Kaplan

[57] ABSTRACT

An assembly for releasably locking doors, windows and the like. A lock pin movable between locking and unlocking positions is retained by a lock bar in both of these positions with the lock bar also preventing removal of the lock pin from the assembly.

2 Claims, 4 Drawing Figures

LOCK WITH RETAINER

BACKGROUND OF THE INVENTION

The present invention relates to locking devices and more particularly the invention relates to a locking mechanism for windows, doors or the like.

As commonly found, some window or door locks employ a turnable cam or latch plate adapted to interengage a relatively stationary latch. These "locking" components are usually found adjacent the window glass on the window frame or sill. From a security standpoint such an arrangement leaves room for improvement. Quite obviously unauthorized entry can be effected by breaking the glass, reaching in and rotating the locking cam clear of the latch.

In order to secure the locking cam from unauthorized movement various prior art devices have been employed. For example, it has been suggested to use external padlocks and the like to secure the relatively movable cam plate. Yet, this method has its drawbacks in that keys must be kept or combinations memorized. A better solution is found in U.S. Pat. No. 3,413,830. In this patent a latch assembly is disclosed wherein a locking device is made integral with the latch mechanism. As described, a feature of this invention is the use of rotatable flanges or collars having projecting chordal segments that when placed in predetermined angular positions permits or constrains axial movement of a locking bolt. The position of the locking bolt in turn governs the placing of the apparatus in a locked or unlocked configuration. Axial displacement of the lock bolt governs movement of a lock pin. However, when the lock pin is withdrawn from the apparatus no means is provided for its retention and thus it is prone to being misplaced.

SUMMARY OF THE INVENTION

Accordingly, it is therefore an object of the present invention to provide a lockable latch assembly whose operable components remain assembled therewith.

It is another object of the present invention to provide a lockable latch assembly utilizing a locking pin that will remain assembled with the device without the use of chains or the like.

BRIEF DESCRIPTION OF DRAWINGS

In the drawings wherein similar reference numerals denote similar elements throughout the several views.

DESCRIPTION OF PREFERRED EMBODIMENTS

Figure 2:
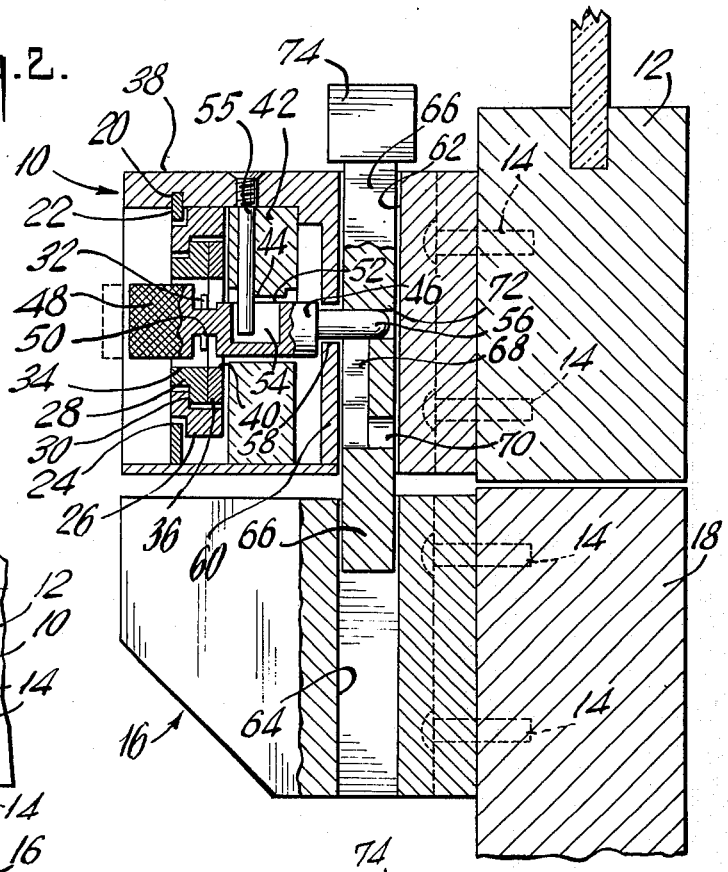
FIG. 2 is an enlarged cross-sectional view taken on line 2—2 of FIG. 1 showing the locking pin in the locked configuration.
Figure 1:
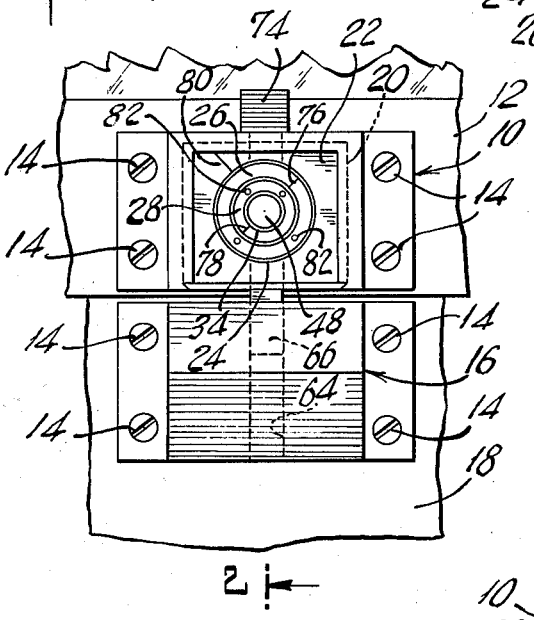
FIG. 1 is a front view of the present invention with one part thereof attached to a window, and another part thereof attached to the sash. The window and sash are shown fragmentarily.

Referring to drawings, there is shown a housing or frame 10 secured to a window sash 12 by means of, for example, screws 14. Similarly a frame 16 is attached to, for example, window frame 18 by means 14.

Frame 10 comprises a protruding housing 38 generally of rectangular shape. The inside surface of housing 38 is formed with a groove 20. Secured within groove

20 is a face plate 22 formed with a circular aperture 24. A flanged ring 26 is rotatably seated in aperture 24 and is concentric therewith. Ring 26 on its outboard face is, preferably, flush with plate 22 as shown. A second or intermediate flanged ring 28 having shoulder 30 is rotatably seated in and coaxial with ring 26. Ring 28 is formed with central aperture 34 into which projects a chordal section or segment 32 that is integral with ring 28. Segment 32 is dimensioned to project a short distance into aperture 34. A flat washer 36 abuts against the rearward face of ring 28 and is formed with an enlarged central aperture 40 concentric to and sized the same as aperture 34. Washer 36 includes a chordal section or segment, not shown, that projects a distance into central aperture 40 similar to that distance covered by segment 32. Washer 36 is connected to flanged ring 26 for rotation therewith, as by a peripheral projection of washer 36 received in a notch of ring 26. As is apparent from FIG. 2 ring 26 is freely rotatable in aperture 24, and ring 28 is independently rotatable in ring 26.

A support block 42 is positioned rearward of the aforesaid rings and is attached to the inside of housing 38. Support 42 includes a bore 44 smaller than and in line with aperture 40.

A lock bolt 46 on one end includes a knurled knob 48. Knob 48 extends through aperture 34 so as to project from the plane defined by the outboard faces of plate 22, and rings 26 and 28. An annular recess 50 is formed in bolt 46 adjacent to knob 48 and extends in an axial direction along bolt 46 a distance to include the thickness of the chordal sections of ring 28 and washer 36. Annular recess 50 receives the projected length of the two chordal segments so that bolt 46 is not axially movable when the segments extend into recess 50. A flat 52 running longitudinally of bolt 46 is placed along a peripheral segment thereof. As seen, one end of the flat adjoins recess 50. Flat 52 is dimensioned so that when the chordal segments are accurately registered angularly with respect to each other and the flat, bolt 46 can then slide thereunder from the position of FIG. 2 to that of FIG. 3. A limiting groove 54 is formed along a portion of flat 52 so as to project radially inward therefrom. A stop 55 is secured to support 42 with one portion extending into groove 54. The rear end of bolt 46 forms a locking projection 56 that extends through an aperture 58 that is formed through intermediate housing wall 60. A passageway 62 is included in frame part 10 and has one wall defined by intermediate wall 60. Preferably passageway 62 will be perpendicular to the bolt 46.

Figure 3:
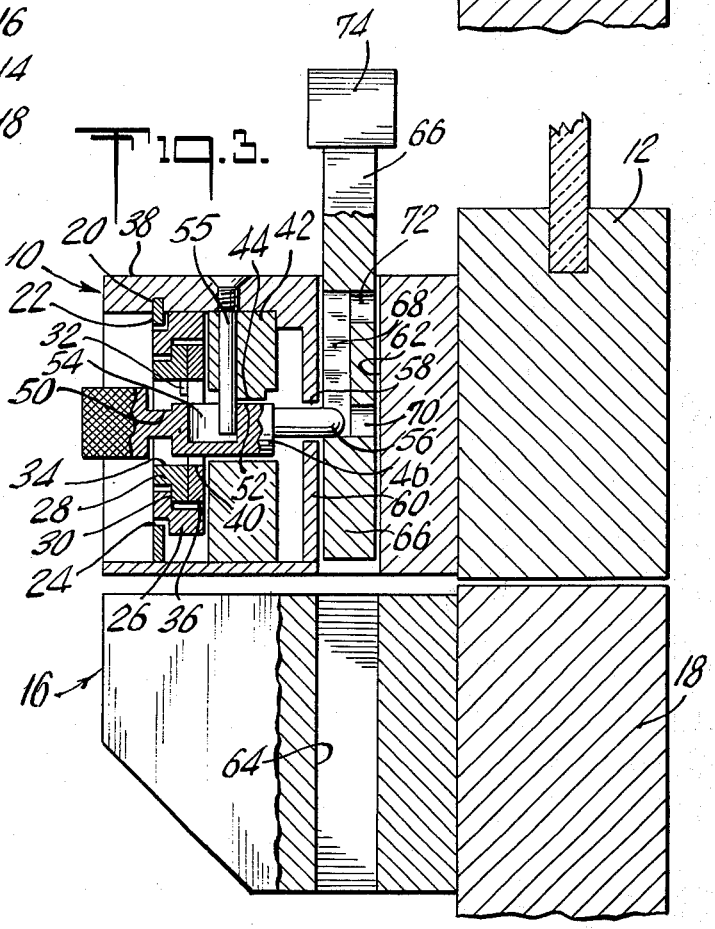
FIG. 3 is a view similar to FIG. 2 but showing the apparatus unlocked.
Figure 4:
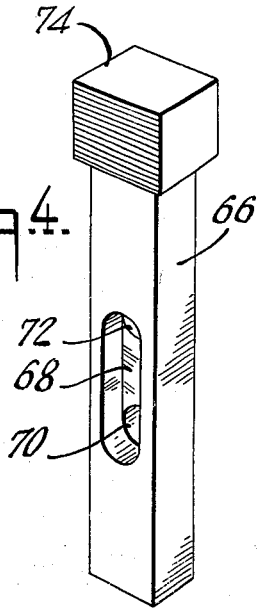
FIG. 4 is a perspective view of the locking pin.

Lower housing part 16 includes a passageway 64 that is aligned with and has a cross section identical with that of passageway 62. A locking bar or pin 66 has a cross section complementary with passageways 62 and 64 and is dimensioned to slide therein. Formed intermediate the ends of bar 66 and placed on the front face thereof is an elongated recess or groove 68. Bores 70 and 72 are positioned at respective opposed ends of groove 68. Bores 70 and 72 are dimensioned so as to slidably receive end bolt part 56. The length of groove 54 is at least sufficient to permit end 56 to be withdrawn clear of either bore 70 and 72, but the groove is not long enough to permit end 56 to be pulled free or clear of the groove 68. With this construction bolt end 56 remains in groove 68 even when withdrawn from the bores so that the extent of upward or downward displacement of bar 66, when looking at either FIG. 2 or 3, is determined by the length of the groove 68. The groove 68 is long enough to permit bar 66 to be withdrawn from passageway 64 as described hereinafter. Bar 66 further includes a head 74 extending from the top of housing 38 as shown. The head is used for lifting the bar and operating the device as will now be described.

Operation of the assembly can best be understood with reference to, and comparison of, FIGS. 2 and 3.

In FIG. 2 the device is shown locked. That is, lock pin 66 concomitantly engages passageways 62 and 64. Both chordal sections are in recess 50 and are positioned therein at random orientations with respect to their common axis. Thus, normally the chordal section integral with washer 36 and hence governed by rotating ring 26 will be oriented other than parallel with flat 52. Consequently, the shoulder portion or face of recess 50 opposed to the lateral face of this chordal segment will abut against same if one pulls outwardly on bolt head 48. End 56 will remain in aperture 72 locking bar 66. In the improbable event that the chordal section of washer 36 happens to be oriented so that flat 52 can slide thereunder, the above-mentioned same shoulder portion or face will most likely strike some part of chordal segment 32. In this event, the axial displacement of bolt 46 is still insufficient for end 56 to be fully withdrawn from aperture 72 and hence bar 66 remains locked.

To unlock the device rings 26 and 28 are rotated with respect to each other so as to place the chordal segment leading edges in line or parallel with flat 52. To facilitate this orientation sight lines or indicia 76, 78 and 80 are inscribed respectively on rings 26 and 28, and plate 22. When the indicia form a continuous line the chordal segments will be in line and parallel with flat 52. Thus pulling outward on head 48 will cause bolt 46 to move out as flat 52 passes under the chordal segments. During leftward displacement of bolt 46, as seen in FIG. 3, stop 55 abuts against the right or inner end of limiting groove 54 thereby limiting travel of the bolt. The axial length of groove 54 in conjunction with stop 55 and groove 68 compels end 56 to remain in the groove 68 while being clear of aperture or bore 72. Bar 66 can now be removed from passageway 64 by pulling on head 74. Since end 56 is constrained to remain in groove 68 the upward, or for that matter downward displacement of bar 66 is limited by engagement between end 56 and the opposed ends of groove 68. When end 56 is inserted in aperture 70 the device can be maintained with bar 66 up in the unlocked configuration.

Indentations 82 may be formed on the outboard face of rings 26 and 28 to aid in their rotation and hence facilitate orientation of the chordal segments. It will be readily appreciated that not only will the inventive device find application in doors and windows, but utility can be found in other lockabel closures where it may be necessary to prevent accidental locking, for example where children play.

While only a single embodiment of the present invention has been shown and described it will be apparent that many changes and modifications can be made hereto without departing from the spirit and scope of the invention.

What I claim is:

1. A lock assembly comprising a housing, a locking bolt axially movable therein, a lock pin perpendicular to said bolt and longitudinally movable in said housing between locking and unlocking positions, said pin being formed with a lock bore receiving a part of said bolt when said pin is in said locking position thereof, so that when said part of said bolt is in said bore said bolt maintains said pin in said locking position thereof, said pin being longitudinally movable to said unlocking position thereof upon retraction of said part of said bolt from said bore and said pin being formed with a longitudinal groove which extends from said bore and in which said part of said bolt is situated during movement of said pin from said locking to said unlocking position thereof, and limiting means carried by said housing and engaging said bolt for limiting the latter only to axial retraction movement out of said bore to an extent where said part of said bolt remains situated in said groove during movement of said pin from said locking to said unlocking position thereof, said groove having distant from said bore an end which engages said part of said bolt when the latter is retracted to release said pin for movement to said unlocking position thereof, whereby said end of said groove cooperates with said part of said pin for determining the unlocking position of said pin while at the same time preventing removal of said pin from said housing with said limiting means preventing removal of said bolt from said housing, said limiting means including a portion of said bolt formed with a longitudinally extending opening and a limiting pin carried by said housing to remain stationary with respect thereto, said limiting pin extending into said opening and engaging one end of said opening when said bolt is retracted from said bore so that said limiting pin by engaging said one end of said opening maintains said part of said bolt in said groove of said pin.

2. The combination of claim 1 and wherein said pin is formed at said end of said groove which engages said part of said bolt when said pin is in said unlocking position thereof with a second bore for receiving said part of said bolt when the latter is returned to the same position with respect to said housing as when said part of said bolt is received in said locking bore, whereby said second bore when receiving said part of said bolt serves to maintain said pin in said unlocking position thereof.

* * * * *